United States Patent [19]

Orthwein

[11] 4,328,872

[45] May 11, 1982

[54] ANTI-BUCKLING DEVICE FOR MINE-ROOF BOLTING MACHINES

[76] Inventor: William C. Orthwein, P.O. Box 3332, Carbondale, Ill. 62901

[21] Appl. No.: 20,117

[22] Filed: Mar. 13, 1979

[51] Int. Cl.[3] ..... B23B 47/22; E21C 5/11

[52] U.S. Cl. ..... 173/160; 173/38; 91/405; 182/19

[58] Field of Search ..... 173/38, 160; 91/404, 91/405, 451, 452; 182/19

[56] References Cited

U.S. PATENT DOCUMENTS

| | | |
|---|---|---|
| 2,320,874 | 6/1943 | Lehmann . |
| 2,322,741 | 6/1943 | Osgood . |
| 2,333,487 | 11/1943 | Nast . |
| 2,754,804 | 7/1956 | Miller . |
| 3,211,025 | 10/1965 | Mottu . |
| 3,247,913 | 4/1966 | Hallberg et al. . |
| 3,670,826 | 6/1972 | Hanson et al. . |
| 3,724,559 | 4/1973 | Stromnes . |
| 3,756,669 | 9/1973 | Bucelluni . |
| 3,835,939 | 9/1974 | McEntire . |
| 3,933,208 | 1/1976 | Bailey et al. . |
| 3,967,686 | 7/1976 | Foegelstroem . |

*Primary Examiner*—Robert Mackey

*Attorney, Agent, or Firm*—Schwartz, Jeffery, Schwaab, Mack, Blumenthal & Koch

[57] ABSTRACT

The invention comprises generally apparatus for use with an underground mine-shaft roof-bolting machine having a torque motor, a pinning rod held for rotation by the torque motor, a controllable arrangement for exerting upward thrust on the torque motor to force the pinning rod upwardly into the roof of a mine shaft, and a manual control for the upward thrust arrangement. In a first embodiment, a contoured cam rotates in dependence on the elevation of the torque motor, while a valve controlled by the cam limits the maximum upward thrust applied to the torque motor such that the maximum upward thrust on the torque motor is reduced when the torque motor is at a comparatively low elevation and is increased when the torque motor is at a comparatively higher elevation. Variations of the cam arrangement permit adjustment for use in mine shafts having different roof heights, and permit use with different types of roof-bolting machines.

A second embodiment of the invention utilizes a nonlinear spring to control the limit valve. A third embodiment utilizes a light beam to detect buckling of the pinning rod and to disable the upward thrust means, while a further embodiment employs a Scotch yoke and pin to control a limit valve.

8 Claims, 16 Drawing Figures

ANTI-BUCKLING DEVICE FOR MINE-ROOF BOLTING MACHINES

BACKGROUND OF THE INVENTION

1. Field of the Invention

The invention relates to safety apparatus for preventing buckling of pinning rods used with underground mine-shaft roof-bolting machines.

2. The Prior Art

Hydraulically-operated roof-bolting machines for underground mine shafts have been known for some time. Such machines typically have a torque motor, a pinning rod held for rotation by the torque motor, a hydraulic device for exerting upward thrust on the torque motor to force the pinning rod upwardly into the roof of a mine shaft, and a device for manually controlling the upward thrust device. Many of the roof bolters which are now commercially available have a hydraulically operated boom for raising the torque motor, the boom including a linkage arrangement for maintaining the pinning rod in a vertical position. One commercially-available roof bolter has a hydraulic cylinder for raising the torque motor, the hydraulic cylinder being here directly mounted on the roof bolter frame or, in some cases, mounted on the end of a hydraulic boom.

In addition, devices are known for hydraulically controlling the rate of pinning-rod infeed so as to increase the drilling rate for softer rock and decrease the drilling rate for hard spots. For example, U.S. Pat. No. 2,320,874 to LEHMANN controls the infeed rate and includes a threshold level pressure cutoff which stops the infeed when the pressure in the feed cylinders builds up beyond a predetermined level.

Another type of automatic feed-pressure regulator is shown in U.S. Pat. No. 2,322,741 to OSGOOD. In this device, the feed control means is automatically responsive to variations in the resistance to drill bit penetration. An arrangement for providing optimum feed force to the mining drill in a pneumatic system is shown in U.S. Pat. No. 2,754,804 to MILLER.

SUMMARY OF THE PRESENT INVENTION

Roof bolting is necessary because U.S. mining practice is to use passages of rectangular cross-section in underground mining, which induces failure of the rock near the center of the passage. Regulations, therefore, require the mining company to insert bolts ranging in length from 2 to 8 feet in the mine roof at regular intervals to keep the rock in place. These bolts are installed by a machine which uses a bit and a long extension shank, often called a pinning rod, a first drill a hole in the roof and to then insert a long bolt with an expansion anchor on the upper end. Buckling of the pinning rods during the pinning operation is common because the bolting machines can exert enough thrust to easily bend the pinning rod as it begins to drill into the mine roof. Although the insertion thrust may be manually controlled by the operator, bolting machines have proven to be dangerous and, in numerous cases, machine operators have been seriously injured or even killed as the pinning rods have buckled.

The present invention is directed to the concept of eliminating or, at least, reducing the possibility of buckling of the pinning rod as used in underground roof bolting. This end is accomplished by use of a variable relief valve to limit the axial thrust that can be applied to the pinning rod by the bolting machine.

In a first embodiment of the invention, an appropriately-contoured cam is connected to the roof bolting machine such that it rotates in dependence on the elevation of the torque motor relative to the bolting machine. A cam follower connected to suitable limiting means detects the position of the cam and results to variable automatic control of the maximum upward thrust on the torque motor in dependence on the elevation of the torque motor. Thus, as the torque motor is raised and the exposed portion of the pinning rod decreases, the maximum allowable axial thrust on the pinning rod is increased. The means for limiting the upward thrust may comprise a hydraulic relief valve which may be fixed in position relative to the cam if the roof-bolting machine is used only in mine shafts having constant roof height, or the valve may be mounted for adjustment, in which case the range of elevations of the torque motor for which the device is effective may be varied according to roof height.

In a second embodiment of the invention, a non-linear spring arrangement is substituted for the contoured cam means such that the activation pressure applied to the relief valve varies with the elevation of the torque motor. In a preferred variation of this embodiment, the non-linear spring comprises a Belleville spring assembly.

In a third embodiment of the invention, a light beam is projected along the length of and substantially parallel to the pinning rod, such that buckling of the pinning rod causes interruption of the light beam and a resultant disabling of the means for providing upward axial thrust on the pinning rod.

A fourth embodiment employs a Scotch yoke and pin arrangement to control the thrust limiting means in dependence on the elevation of the torque motor.

THE PREFERRED EMBODIMENTS

Figure 1:
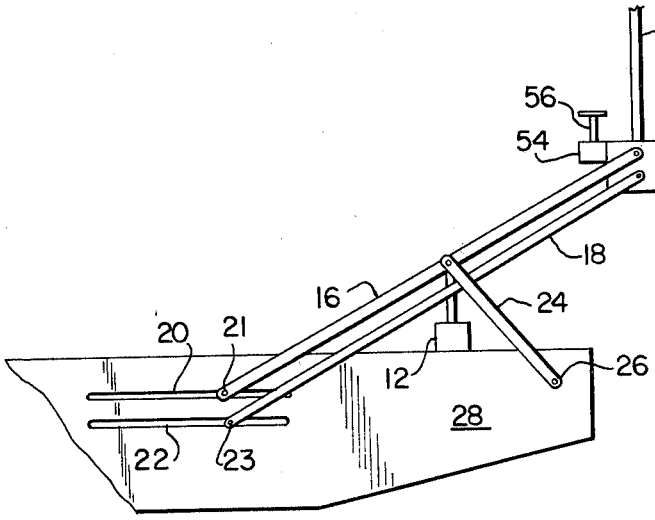
FIG. 1 illustrates the essential elements of one type of commercially-available mine-roof bolting machine, with partial modification for use with the present invention, in elevation.

FIG. 1 shows in partial elevation the linkage used in one commercially-available roof bolter to elevate the torque motor, pinning rod, and bit. Pinning rod 10 (also called a drill rod) is forced upwardly into a mine roof (not shown) under thrust from cylinder 12, the bit (not shown) and drill rod 10 being rotated by a torque motor 14. Main boom members 16 and auxiliary boom members 18, located on both sides of the torque motor, have their respective upper ends pivotably connected to the side of torque motor 14 and their lower ends respectively mounted on shafts 21, 23, respectively, for pivotal sliding motion in tracks 20 and 22. A forward link 24 is pivotally mounted at one and to boom 16 and is mounted for rotation at the other end about a stub shaft 26 on the frame 28 of the roof bolter.

Figure 2:
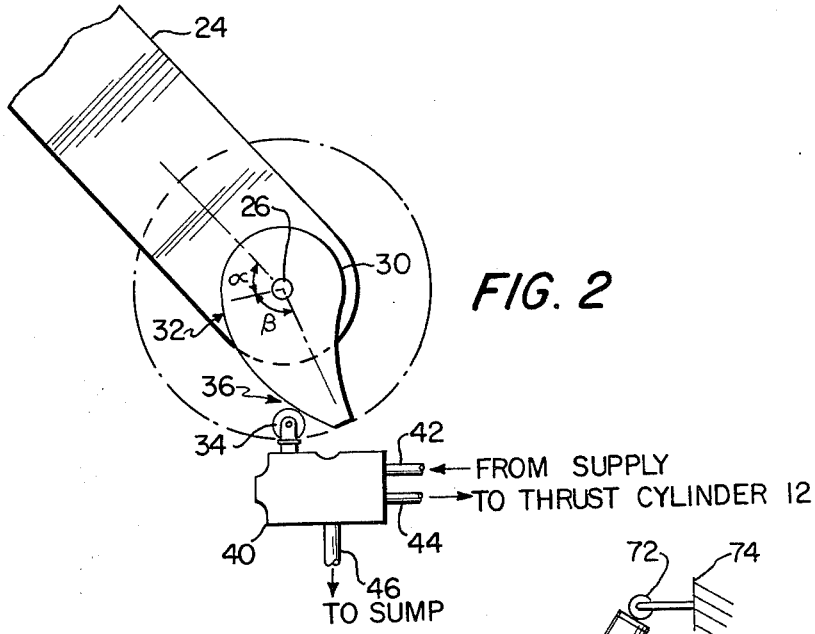
FIG. 2 is a partial elevation of the roof-bolting machine of FIG. 1, with modification according to a first embodiment of the invention.
Figure 4:
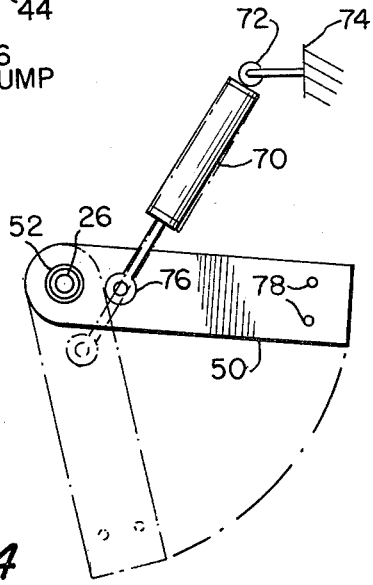
FIG. 4 shows in elevation additional components of the arrangement of FIG. 3 which are not shown in FIG. 3.

Because shaft 26 does not translate relative to the roof bolter frame, a cam 30, as shown in FIG. 2, is welded or otherwise rigidly attached to the outside of forward link 24 so that it rotates coaxially with link 24 about shaft 26. Cam 30 is oriented with respect to the center line of forward link 24 such that the lowest upward thrust from cylinder 12 is permitted when point 32 is in contact with cam follower 34, i.e., generally when link 26 is at or below the horizontal, depending upon the particular machine design. The greatest upward thrust permitted by cylinder 12 occurs when link 24 and cam 30 have rotated about shaft 26 until cam follower 34 is in contact with point 36 of the cam, as shown in FIG. 2. This corresponds to the uppermost position of torque motor 14 and the clockwise-most position of forward link 24. Relief valve 40 is either rigidly attached to bolter frame 28, for machines to be used in constant height seams, or to a movable arm 50, as illustrated in FIG. 4, for machines to be used in variable height seams. Cam follower 34 controls the relief pressure of valve 40 and thereby controls pressure from hydraulic supply line 42 through hydraulic line 44 to thrust cylinder 12 of FIG. 1. Depending upon the particular type of relief valve used, a sump return line 46 may be provided.

Figure 3:
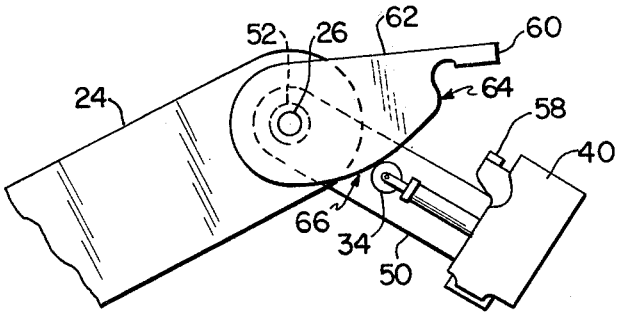
FIG. 3 is a partial elevation of the roof-bolting machine of FIG. 1, with modification according to a variation of the first embodiment.
Figure 5:
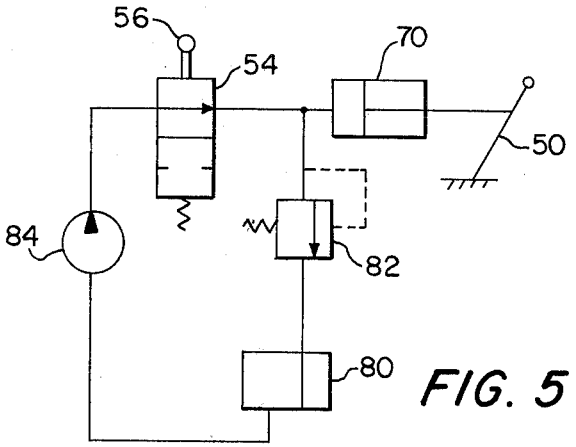
FIG. 5 shows a schematic hydraulic indexing circuit for use with the embodiment of FIGS. 3 and 4 and the embodiment of FIG. 11.

Adjustment may be made for variable mine roof height with the arrangement shown in FIGS. 3 and 4 and the associated hydraulic circuit of FIG. 5. This requires that relief valve 40, also known as a pilot-operated pressure control valve, be mounted on an arm 50 which is in turn mounted on bearings 52 on the stub shaft 26 about which link 24 rotates. Arm 50 is, however, free to turn independently of the rotation of link 24. The operation of arm 50 and the associated mechanism is best explained in a series of operational steps.

Step 1: The pilot drill, which is a short drill for making a shallow hole in the roof so that the bit on the longer pinning rod to be used next can start into the pilot hole and not skid to one side as thrust is applied, is inserted in the thrust motor and the thrust motor is raised to a position just below the mine roof. A valve 54, affixed to the thrust motor as shown in FIG. 1, has an operating rod 56 which makes contact with the mine roof and causes valve 54 to open. This in turn causes cylinder 70 (FIG. 4) to retract and to rotate arm 50, on which relief valve 40 is attached, in the counterclockwise direction until stop 58 contacts stop 60 of cam 62. Thus, cam follower 34 is at point 64 on cam 62 and maximum pressure is permitted to the thrust cylinder 12 of FIG. 1. When boom 16 of FIG. 1 is lowered, the spring-loaded operating rod 56 of valve 54 returns to its closed position, closing the hydraulic lines to cylinder 70. Thus, arm 50 and, with it, valve 40, is fixed in position relative to the bolter frame and relative to shaft 26. As boom 16 is lowered, link 24 and, with it, cam 62, rotate counterclockwise and cam follower 34 moves from point 64 toward, but not necessarily to, point 66 on cam 62. The rest position between points 64 and 66 determine the maximum initial thrust available as the boom is once again raised in step 3, below.

Step 2: The boom is lowered, with arm 50 and relief valve 40 hydrualically locked in position relative to bolter frame 28 by cylinder 70.

Step 3: The short pilot drill is removed from torque motor 14 and replaced by a long pinning rod 10. Relief valve 40 remains locked in position relative to bolter frame 28 so that the pressure available to the thrust cylinder 12 increases as the boom 16 rises because cam follower 34 is now moved to point 64 as cam 62 and link 24 rotate clockwise about shaft 26. The contour of cam 62 is designed such that the upward axial thrust on pinning rod 10 is limited sufficiently to prevent buckling of the pinning rod. If the torque motor is raised sufficiently for the operating rod 56 of indexing valve 54 to contact the roof again, valve 40 may be slightly repositioned as the indexing system is activated. This is, however, of no consequence because it will not reduce the maximum thrust that is available since any motion of the indexing system will simply bring cam follower 34 closer to point 64 on the cam.

Step 4: The main boom is lowered as in Step 2. After the boom is lowered, the bolting machine may be moved to a new position in the mine. Step 1, above relocates cam follower 34 along the contour of cam arc 64–66. The length and contour from point 64 to point 66 is determined by the maximum possible upper and lower positions of boom 16 and, therefore, link 24.

If the bolting machine moves from a lower roof to a higher roof, forward link 24 and cam 62 will rotate clockwise until stop 60 of cam 62 contacts stop 58 mounted on relief valve 40, forcing arm 50 to move clockwise. This, in turn, will tend to extend cylinder 70. The increased pressure in cylinder 70 will cause hydraulic fluid to return to sump 80 through relief valve 82, set to a relief pressure slightly higher than that delivered by low pressure hydraulic pump 84 (see the schematic hydraulic indexing circuit of FIG. 5).

Figure 6:
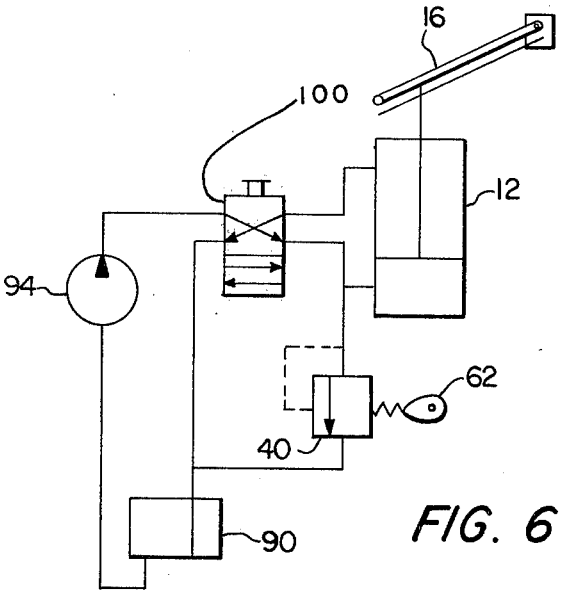
FIG. 6 shows a schematic hydraulic circuit for providing the upward axial thrust on the pinning rod, with means to prevent buckling of the pinning rod.

Referring now to the schematic hydraulic thrust circuit of FIG. 6, thrust cylinder 12 raises boom 16 when hydraulically actuated. Pressure relief valve 40 controls the maximum pressure to thrust cylinder 12, wherein the position of cam 62 determines the pressure required to open valve 40 to the sump 90. In this schematic, pump 94 is a high pressure hydraulic source. Since pump 84 of FIG. 5 is low pressure, it may be replaced by a line from pump 94 and a pressure reducer. An operator control valve 100 is provided for raising and lowering boom 16.

Figure 7:
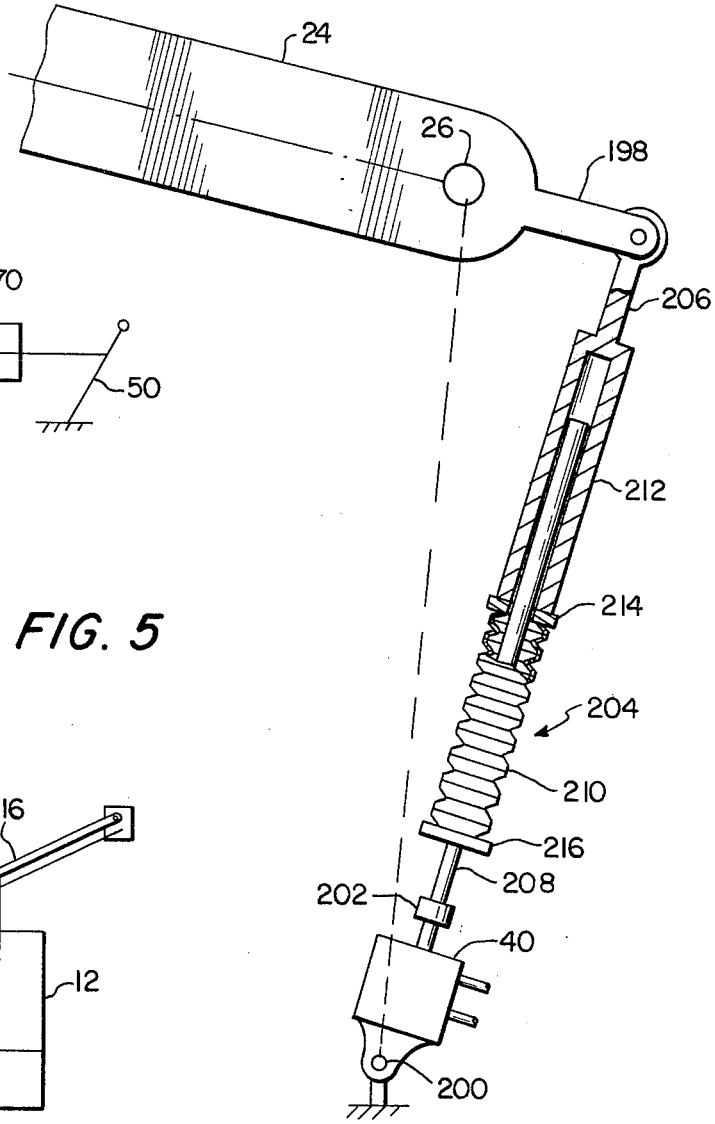
FIG. 7 shows in partial elevation a second embodiment which utilizes a non-linear spring to control thrust in dependence on the elevation of the thrust motor.
Figure 8:
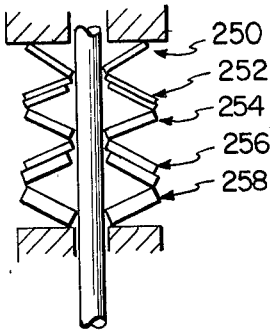
FIG. 8 is a partial cross-sectional elevation of a non-linear spring for use in the embodiment of FIG. 7.
Figure 9:
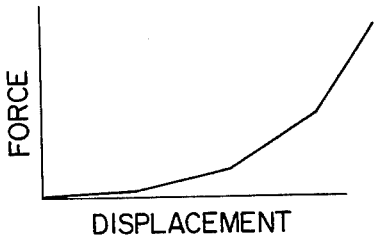
FIG. 9 shows the force-vs.-displacement characteristic of the non-linear spring of FIG. 8.

A further embodiment of the invention will now be described with reference to FIGS. 7, 8, and 9. As an alternative to the use of a cam to control pressure relief valve 40 and thereby regulate the upward thrust of cylinder 12 as a function of boom position (and, hence, exposed pinning rod length), a non-linear spring assembly is used. In this embodiment, an arm 198 extends from the end of forward link 24 radially outwardly from shaft 26. Relief valve 40 is attached to a rotating pivot 200 which is fixed to the frame of the bolting machine. The operating stem of the pilot-operated pressure control valve 40 is suitably connected at 202 to the end of extension arm 208. Extension arm 208 forms the lower member of a telescoping, spring-loaded link assembly shown generally at 204. The assembly 204 comprises a sleeve link 206, plunger link 208, having a cylinder 212 and a Belleville spring assembly 210. Link 206 is concentric with and partially slides over extension arm 208. Force is applied by cylinder 212 on extension arm 208 through shoulder 214, through a series of disk springs 210, and through shoulder 216 on extension arm 208.

Belleville, or disk, springs provide the capability of designing non-linearity into the spring to satisfactorily approximate the buckling force on a pinning rod. For example, a stack of disk springs as shown in FIG. 8 produces a spring assembly having a force-vs.-displacement characteristic as shown in FIG. 9. Relatively little force is required to flatten spring 250, more force is required to flatten springs 252, and increasingly greater forces are required to flatten spring 254, springs 256, and spring 258, respectively. Varying the thickness and the relative positioning of the individual Belleville springs, as shown in FIG. 8, results in a force-vs.-displacement characteristic composed of straight-line segments.

Figure 10:
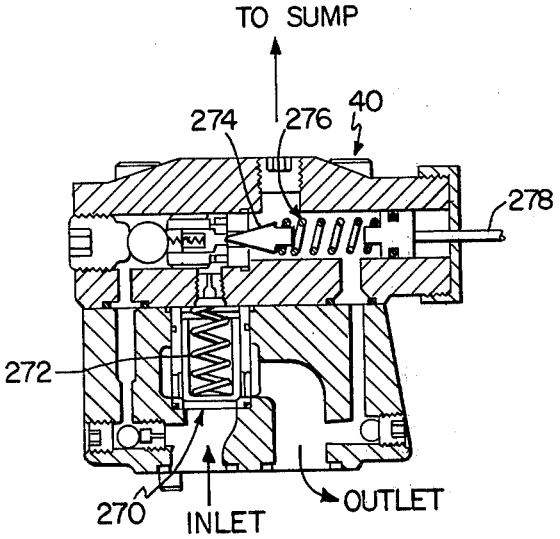
FIG. 10 illustrates in elevational cross-section a particular type of hydraulic relief valve which may be used in the embodiments of the present invention.

As mentioned above, relief valve 40 is preferably a pilot-operated pressure-control valve. While any suitable type of valve which serves the necessary function may be used for valve 40 in the embodiments of FIGS. 2, 3, and 6, it is preferred to use an ABEX-DENNISON valve type R4V configured as shown in FIG. 10. As the valve is provided by the manufacturer, tension on pilot spring 276 is adjustable by a hand control knob, which can be replaced as shown in FIG. 10 by a suitable shaft 278 to which cam follower 34 of FIGS. 2 and 3 or extension arm 208 of FIG. 7 may be attached for operation.

The ABEX-DENNISON relief valve consists of two integral valve sections: a high-flow pilot-operated poppet section 270 beneath, controlled by low-flow, adjustable spring-loaded cone section 274 on top. Spring 276 biases cone 274 in its seated position.

The relief valve may be connected with inlet and outlet connections as shown, and may also be connected to a sump return line where indicated. The high-flow poppet in the relief valve is controlled by the spring-loaded cone, flow entering at the inlet being blocked by the poppet at low pressure. The pressure signal at the inlet passes through orifices to the top side of the poppet and to the cone, and there is no flow through these sections until the pressure rises to the maximum permitted by the spring-loaded cone adjustably set by the position of stem 278. This limits the topside pressure on the poppet.

If the inlet pressure attempts to rise above that, main poppet 270 lifts, passing only enough flow from the inlet to the outlet to keep the inlet pressure at the set value. Main poppet 270 closes instantly when the inlet pressure drops below that value. Control cone 274 is forced off its seat by the pilot signal which flows through orifices around the control block. The control piston acts as a dash-pot to damp oscillations of the cone.

Figure 11:
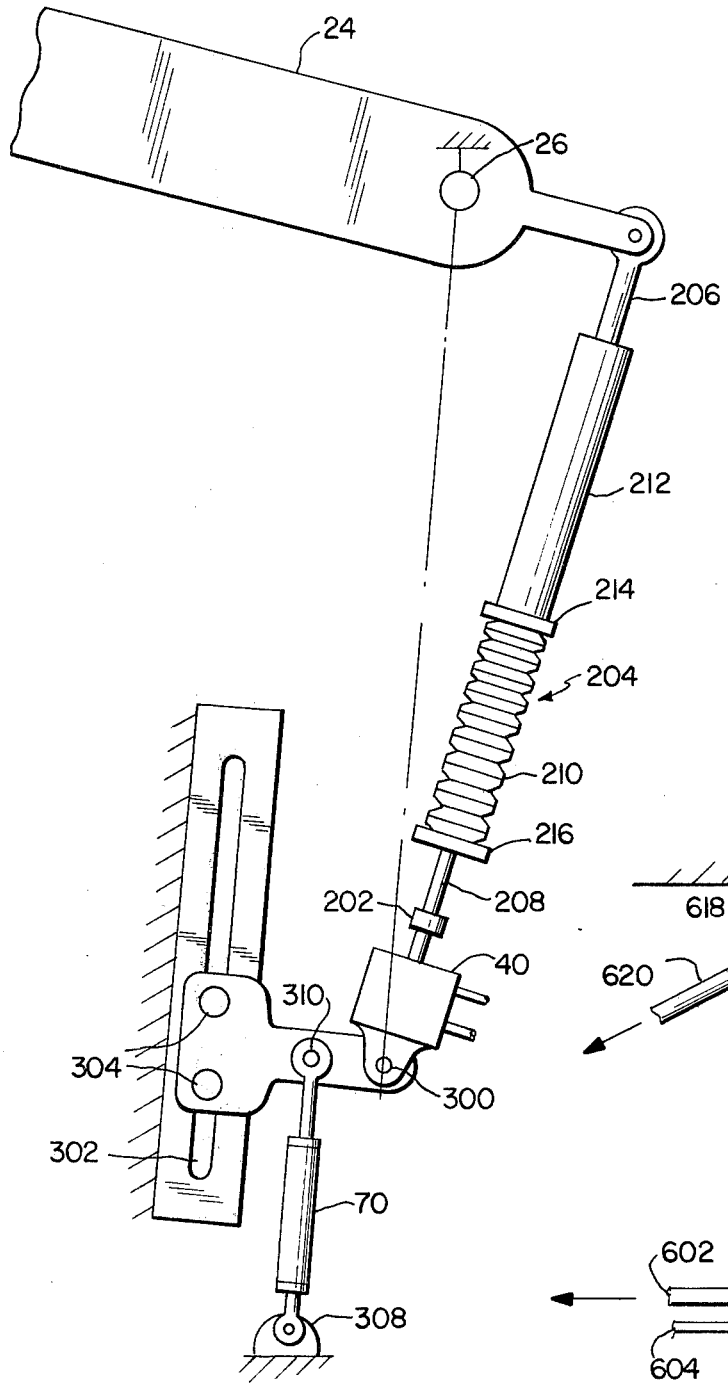
FIG. 11 is a partial elevation of a variation of the embodiment of FIG. 7.

Referring now to FIG. 11, a variation of the embodiment of FIG. 7 will now be described. While the embodiment of FIG. 7 is shown fixed for a specific mine roof height, roof height variation may be accounted for if the non-linear spring assembly is adjustably tensioned by mounting relief valve 40 pivotably at 300 on a sliding support member which is secured by pins 304 in a track 302. Track 302 is secured to frame 28 of the roof-bolting machine (see FIG. 1). The center line of track 302 is parallel to a line through the axis of shaft 26 and the axis of pivot 300. The sliding support member is positioned by means of a hydraulic cylinder 70 which compares with hydraulic cylinder 70 FIG. 4. The schematic hydraulic indexing circuit of FIG. 5 applies also to the embodiment of FIG. 11, with indexing valve 54 mounted on or near the torque motor as before. When the mine roof height decreases, movable relief valve 40 and pivot point 300 are driven upwardly by fluid pressure in cylinder 70 until all disks in the spring assembly 204 are flattened. Upon encountering a still higher roof, the disks will become flattened before operating rod 56 of indexing valve 54 reaches the mine roof. Thus, as the forward link 24 continues to rotate clockwise, pressure in adjusting cylinder 70 causes relief valve 82 of FIG. 5 to open so that pivot point 300 and relief valve 40 are moved downwardly until the roof is reached.

Figure 12:
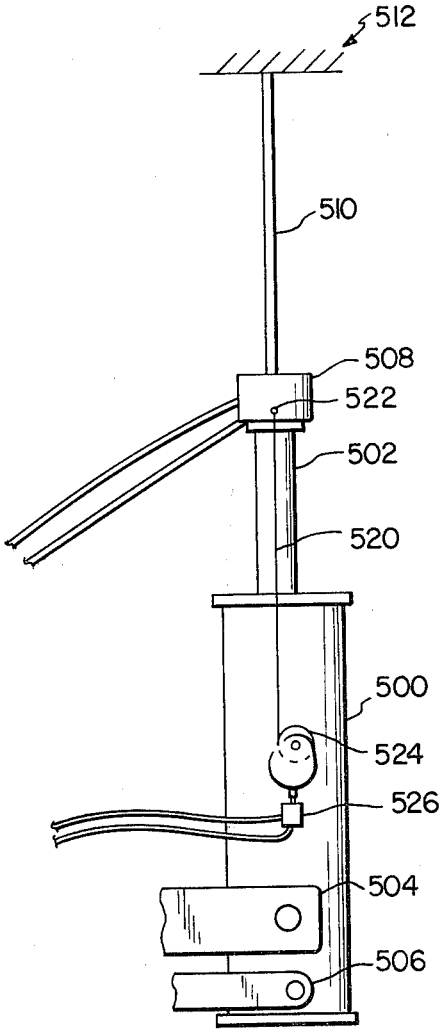
FIG. 12 is a partial elevation of a particular commercially-available roof-bolting machine, with modification according to a variation of the first embodiment of the invention.

Still a further embodiment of the present invention is demonstrated in partial elevation in FIG. 12. One particular type of commercially-available roof-bolting machine, known as a FLETCHER roof bolter, consists of a hydraulic jack 500 having a piston 502 to which a torque motor 508 is attached. In the most versatile of the FLETCHER roof-bolting machines, the hydraulic jack is carried on the ends of hydraulicallyoperated main and auxiliary boom members 504 and 506, respectively. Less versatile FLETCHER machines do not have a boom to raise and lower the thrust cylinder. Buckling control is, however, necessary only on the hydraulic cylinder, and it is in control of thrust only when the boom is in the lowered position on the most versatile machine. For either style of machine, cam control of a pressure relief valve 526 (comparable to valve 40 in the foregoing embodiment) may be had by connecting a cable 520 to the upper end of the piston or to the torque motor at 522. The lower end of cable 520 is wound on a spring-loaded drum 524. The drum is then preferably reduction-geared to a cam which regulates the pilot valve of pressure relief valve 526 as in the foregoing embodiments. The reduction gearing may be by means of planetary gearing internal to the drum itself. Valve 526 may be as in FIG. 10.

Figure 13:
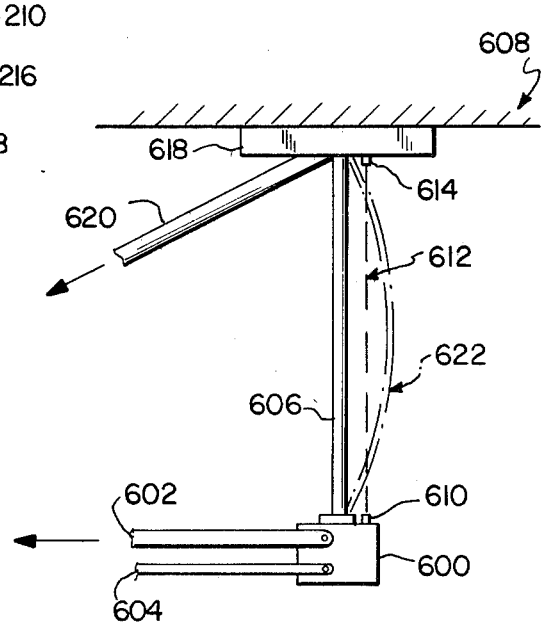
FIG. 13 illustrates in partial elevation a commercially-available roof-bolting machine modified according to still a third embodiment of the invention.
Figure 14:
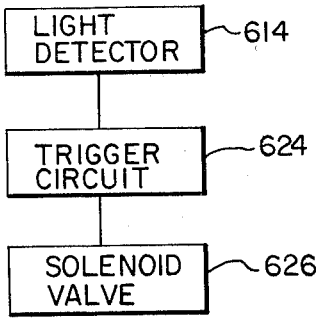
FIG. 14 illustrates schematically a control circuit for use with the arrangement of FIG. 13.

In still a further embodiment of the present invention illustrated in FIGS. 13 and 14, buckling control of pinning rods on either the FLETCHER roof-bolting machines (as in FIG. 12) or the other type of commercially-available roof-bolting machine (as in FIG. 1) is provided. This is achieved by use of a light beam, either in the visible spectrum or in the infra-red spectrum, to detect buckling of the pinning rod. FIG. 13 shows generally the conventional type of bolting machine, having torque motor 600 carried by main boom 602 to an auxiliary boom 604. Pinning rod 606 is held for rotation by the torque motor and is driven by upward thrust of the boom members into mine roof 608. A temporary roof support 618 is provided on the mine roof, and may be carried by a further boom member 620. A light beam projector 610 is mounted on the torque motor and projects a light beam along the length of and substantially parallel to pinning rod 606. The diameter of the light beam is preferably smaller than that of the pinning rod and should be as small as possible, as determined by the capability of the light beam detector 614. The detector, as shown in FIG. 13, is attached to the temporary roof support frame and close to or inside of the hole in the roof support frame to permit the light beam to lie parallel to the pinning rod.

When excessive upward thrust is applied to the pinning rod, sufficient buckling thereof will interrupt the light beam once per revolution. The output of light beam detector 614 is provided to a suitable trigger circuit 624 (FIG. 14) which is preferably sensitive enough to detect a single interruption of the light beam and to, for example, open a solenoid valve 626 which is coupled into the hydraulic line to thrust cylinder 12 (FIG. 1). It is not necessary to provide details of the requisite circuitry here since such circuitry, light sources, light detectors, and solenoid valves are commercially available and well-known. Solenoid valve 626 would, of course, readily substitute for relieve valve 40 in the hydraulic thrust cylinder circuit shown in FIG. 6.

Figure 15:
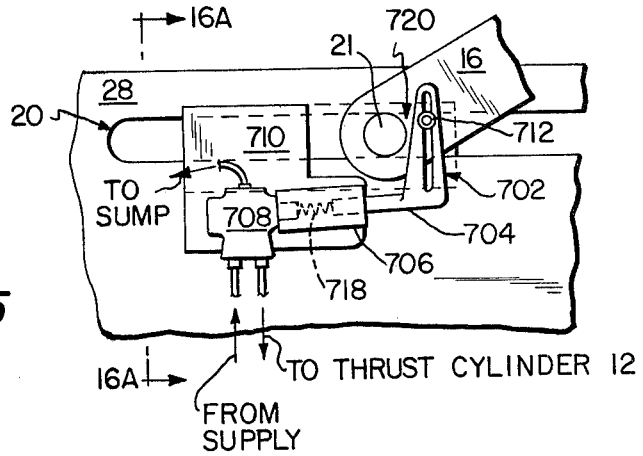
FIG. 15 shows a partial elevation of the roof-bolting machine of FIG. 1, with modification according to a fourth embodiment of the invention.
Figure 16:
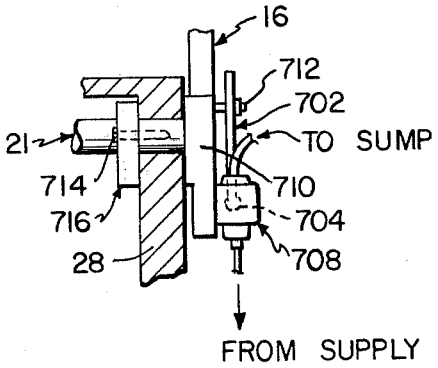
FIG. 16 is a partial cross-sectional view taken along lines 16A—16A of FIG. 15.

Yet another embodiment of the invention is illustrated in FIGS. 15 and 16. FIG. 15 shows in elevational view a part of the frame 28 of the roof bolter of FIG. 1, as well as track 20, shaft 21, and main boom 16. FIG. 16 is a cross-sectional view taken along line 16A—16A of FIG. 15. An offset Scotch yoke 702 has a yoke arm 704 which extends into a guide sleeve 706 mounted on pressure relief valve 708. Valve 708 is preferably a pilot-operated pressure-control valve, and may be an ABEX-DENNISON valve configured as shown in FIG. 10. Valve 708 is coupled to a hydraulic supply line, to thrust cylinder 12 of FIG. 1, and to a sump, and can be substituted for valve 40 in the hydraulic circuit of FIG. 6.

Valve 708 is suitably mounted as shown in FIGS. 15 and 16 on a carrier member 710 having a protruding portion which extends into track 20 of the roof bolter frame 28. A retainer plate 716 is attached to carrier member 710 by bolts 714 such that the assembly is slidably retained in track 20. Retainer plate 716 has a U-shaped notch 720 near one end thereof for engaging shaft 21 and causing carrier member 710 and valve 708 to slide with shaft 21 as boom 16 is raised or lowered.

A pin 712 is mounted on the side of boom 16 at a point spaced apart from shaft 21, so that raising or lowering a boom 16 will cause pin 712 to rotate about shaft 21. Scotch yoke 702 has an elongated opening for receiving pin 712, the opening arranged such that yoke arm 704 moves linearly along the horizontal to position the operating stem of valve 708.

The length of yoke arm 704 may be chosen such that the maximum upward thrust of thrust cylinder 12 (FIG. 1) is available when main boom 16 is at such an angle that torque motor 14 (FIG. 1) is, for example, six feet or more above the mine floor. Any buckling of the pinning rod above that height is not as likely to injure the bolting machine operator.

The maximum upward thrust permitted by valve 708 is lowest when main boom 16 is at a lower position and increases as boom 16 is elevated because yoke arm 704 increases the pressure on spring 718, which in turn increases the control pressure on the operating stem of valve 708. This produces a control curve in which the upward axial thrust on the pinning rod is less than that which would cause buckling as the torque motor is forced upwardly. Spring 718 provides a linear force-displacement relation so that the possibly larger displacement of yoke arm 704 may be matched to the smaller permissible displacement of the pilot valve of valve 708. Means for adjusting the arrangement for different roof heights can be made in a manner similar to that shown in FIG. 11.

While preferred arrangements of the invention have been described above in detail, it is to be noted that further modifications will become apparent to those skilled in the art. Therefore, the scope of protection is to be defined by the following claims.

I claim:

1. Apparatus for use with an underground mineshaft roof-bolting machine having a torque motor, a pinning rod held for rotation by said torque motor, means for exerting upward thrust on said torque motor to force said pinning rod upwardly into the roof of a mine shaft, and means for manually controlling said upward thrust means, comprising means for limiting the maximum upward thrust of said upward thrust means in dependence on the elevation of said torque motor relative to said bolting machine, said limiting means comprising contoured cam means operatively connected to said upward thrust means for rotating about an axis in dependence on the elevation of said torque motor relative to said bolting machine, and cam follower means engageable with said cam means and following the contour of said cam means as said cam means rotates, said limiting means further including a pressure relief valve controlled by and operatively connected to said cam following means and limiting said maximum upward thrust pressure in dependence on the contour of said cam means, said cam means being contoured such that the maximum upward thrust on said torque motor is reduced by said pressure relief valve when said torque motor is at a comparatively low elevation relative to said bolting machine and is increased when said torque motor is at a comparatively higher elevation relative to said bolting machine, whereby the reduced upward thrust on said torque motor at the comparatively low elevation reduces the possibility of buckling of said pinning rod.

2. The apparatus of claim 1, wherein said upward thrust means comprises a hydraulic thrust cylinder, and wherein said relief valve is hydraulically connected to said hydraulic thrust cylinder.

3. The apparatus of claims 1 or 2, wherein said upward thrust means comprises a boom pivotably connected at one end to the frame of said roof bolting machine and at its other end to said torque motor, and a forward link pivotally connected at one end to said boom and at its other end to the frame of said roof bolter, said cam means being mounted for coaxial rotation with said forward link about the pivot point of said forward link on the frame of said roof bolting machine.

4. The apparatus of claim 1, further comprising means for adjustably positioning said limiting means relative to said cam means, whereby the comparative elevations of said torque motor at which said maximum upward thrust is reduced and increased may be adjusted according to the height of the mine roof encountered.

5. The apparatus of claim 4, wherein said positioning means comprises:

an arm having a first end operatively connected for rotation coaxial with but independent of said cam means and a second end carrying said pressure relief valve and said cam following means;

a hydraulic source of predetermined pressure; and an actuatable hydraulic adjusting cylinder hydraulically coupled to said source and pivotably connected at respective ends to the frame of said bolting machine and to said arm for rotating said arm about the axis of said cam means.

6. The apparatus of claim 5, wherein said positioning means further comprises:

stop means located respectively on said cam means and on said pressure relief valve for retstricting the angular rotation of said valve relative to said cam means;

hydraulic detector valve means mounted on said torque motor and hydraulically coupled to said source and to said adjusting cylinder for retracting said adjusting cylinder when said torque motor is raised to a predetermined distance below a mine roof; and hydraulic relief valve means operatively coupled to said adjusting cylinder for permitting extension of said adjusting cylinder, whereby when said torque motor is raised to said predetermined distance below a relatively lower mine roof, said adjusting cylinder retracts to rotate said arm counterclockwise until restricted by said stop means, and when said torque motor is raised to a predetermined distance below a relatively higher mine roof, clockwise rotation of said cam means is transferred to said arm by said stop means and said hydraulic relief valve permits extension of said adjusting cylinder.

7. The apparatus of claim 1, further comprising:

a spring-loaded drum means;

cable means having one end wrapped on said drum means; and means for operatively connecting the other end of said cable means to said upward thrust means, said cam means being operatively connected to rotate in dependence on rotation of said drum means, whereby raising of said thrust motor causes said cable means to unwind from said drum means and thereby rotate said cam means in one direction, and lowering of said thrust motor causes said cable means to rewind due to the spring-loading of said drum means and thereby rotate said cam means in the opposite direction.

8. The apparatus of claim 7, further comprising reduction gear means operatively coupling said cam means to said drum means.

* * * * *